United States Patent [19]

Martens et al.

[11] Patent Number: 5,069,451

[45] Date of Patent: Dec. 3, 1991

[54] HOCKEY PRACTICE DEVICE

[76] Inventors: Kent L. Martens, Box 306; Harvey W. Schulz, Box 356, both of Herbert, Saskatchewan, Canada, S0H 2A0

[21] Appl. No.: 539,138

[22] Filed: Jun. 18, 1990

[51] Int. Cl.[5] ..... A63F 71/02

[52] U.S. Cl. ..... 273/57.2; 124/47; 124/79

[58] Field of Search ..... 273/1 B, 129 V, 87.2, 273/87.4, 57.2; 124/79, 47, 49; 221/268, 272, 274

[56] References Cited

U.S. PATENT DOCUMENTS

| | | | |
|---|---|---|---|
| 1,429,656 | 9/1922 | Stonebridge | 273/87.2 |
| 1,481,105 | 1/1924 | Levy | 273/129 V X |
| 2,469,016 | 5/1949 | Stopper | 124/47 |
| 2,527,284 | 10/1950 | White et al. | 124/49 X |
| 3,263,860 | 4/1967 | Haas | 221/274 |
| 3,313,452 | 4/1967 | Katz | 221/268 |
| 3,665,910 | 5/1972 | Boni | 273/1 B X |
| 3,734,503 | 5/1973 | Breslow | 124/47 X |
| 3,794,318 | 2/1974 | Holmes | 273/1 B |
| 3,838,677 | 10/1974 | Alvares | 273/1 B X |
| 3,876,201 | 4/1975 | King | 273/1 B |
| 4,607,842 | 8/1986 | Daoust | 273/1 B |
| 4,915,384 | 4/1990 | Bear | 273/1 B X |

FOREIGN PATENT DOCUMENTS

| | | |
|---|---|---|
| 950782 | 7/1974 | Canada . |
| 1221593 | 5/1987 | Canada . |

*Primary Examiner*—Paul E. Shapiro

[57] ABSTRACT

This device is intended to be used by the novice or the professional to develop or retain particular skills used in the game of hockey. There is provided a base, a support mounted on the base which carries a tube in an upright manner about 1½ puck thicknesses above the central portion of the base. The tube is loaded with several pucks which are fed down through the tube by gravity onto the base. A bent discharge lever is pivotably mounted in the tube support and when actuated by an impact from a hockey stick of a user the foot of the lever shoots out the puck resting on the base while holding the next puck in the tube until a weight fixed to the lever returns it to its initial position. Gravity then automatically places another puck on the base ready for discharge.

16 Claims, 1 Drawing Sheet

HOCKEY PRACTICE DEVICE

FIELD OF INVENTION

This invention relates to dispensers and more particularly to dispensers for hockey pucks for the development of hockey skills.

BACKGROUND OF INVENTION

The game of ice hockey has been developing at a rapid pace. The cost of equipment, ice time and ones own personal time has also increased. Various devices have been developed to overcome the above costs and to maximize the results one achieves when ones time is limited. Keen competition and personal achievement are playing a significant role.

To overcome the above problems most of which are encountered by young hockey players, a device has been developed by applicant which can contribute immensley to ones skills in handling and shooting of a hockey puck. This device is a simple mechanical device that can be used at home or elsewhere whenever you have the time or inclination. You can speed up or slow down the process as you wish. In combination with a target this device can take the form of a game each player testing his speed and accuracy for a given number of pucks to be discharged.

A search of the prior art has revealed several patents the most closely related being Canadian Patents 1,111,593, 950,782 and U.S. Pat. No., 2,469,016. Canadian patent "593" while showing a puck storage cylinder teaches a device that has an indexing means for releasing the pucks and a driver and guide means directing the puck downwardly. Applicants device differs considerably in that it teaches gravity feed of pucks in a tube, the discharge of the pucks being by a bent discharge lever which also controls the feeding of the pucks onto the base. Canadian patent "782" teaches coaxial discs gripping a puck and accelerating it until released through a hole in the wall of the accelerating chamber. Applicants device has a tube of pucks gravity fed and discharged by bent lever means, the bent lever controlling the successive feeding, of pucks onto the base. U.S. Pat. No. 2.469,016 while having projectiles in the form of gravity fed discs does not have them in a tube nor are they discharged by a bent lever mechanism. None of the above art singley or combined even suggests the basic principles for which applicant seeks protection.

SUMMARY OF INVENTION

This invention relates to a hockey puck dispenser and comprises in general a base, an upright support mounted on the base and mounted on the support is a tube clamp mounting. A tube is held vertically to store a stack of hockey pucks, clamps fastened to the tube clamp mounting hold the tube about 1 ½ puck heights above the base. Pivotally mounted in the tube clamp mounting is a discharge lever which upon activation ejects the lowermost puck at a velocity proportional to the rotational power applied. A weight is fixed to the discharge lever to return it to its initial starting position after discharge of a puck.

It is an object of the above invention to provide a hockey practice device that will develop ones puck handling, shooting, and eye-hand coordination abilities.

It is another object of this invention to provide a reversible puck dispenser for right hand or left hand players.

It is a further object of this invention to provide an off the ice hockey skills developer.

It is a further object of the present invention to provide a readily portable puck dispenser.

It is yet another object of the instant invention to provide a sturdy, durable and easily manufactured skills developing device.

Further objects and a fuller understanding of the instant invention will be realized when read in conjunction with the following accompanying drawings wherein like elements will be identified by like numerals.

DETAILED DESCRIPTION OF THE INVENTION

Figure 1:
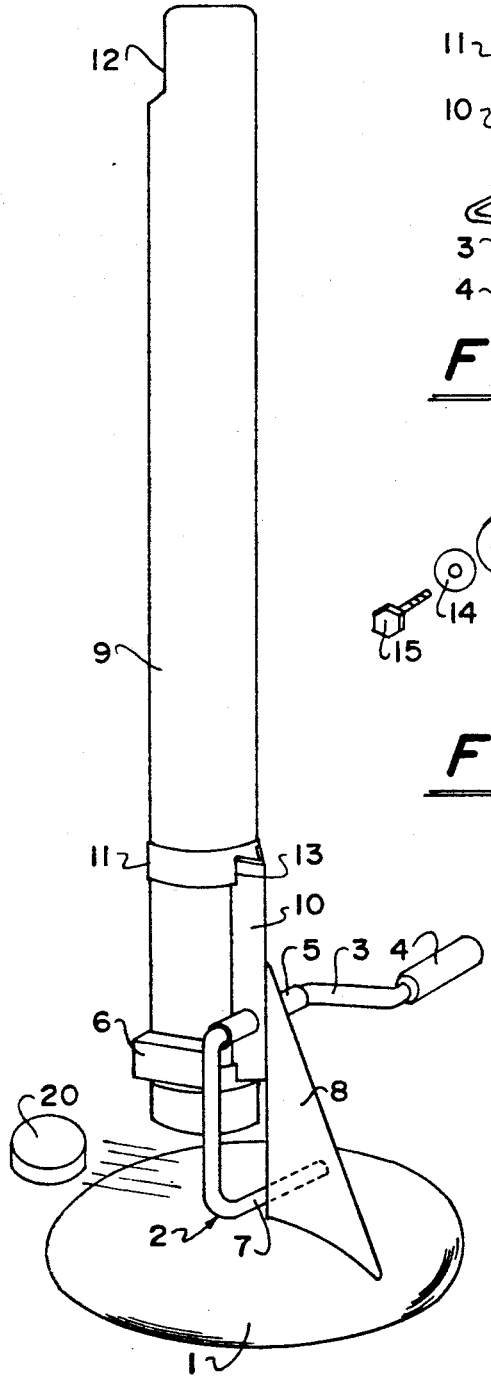
FIG. 1 is a perspective view of the instant invention.

Referring now to FIG. 1 there is illustrated a device for hockey practice. This device has a base 1 which is normally round and slightly concave with the concavity facing downwardly. Flat bases of various shapes and material can also be used. On the base 1 is an upright support 8 fixed thereto. Attached to the support 8 is a tube clamp mounting 10 which carries the tube clamps 11 and a bearing 5 for the discharge lever 2. The discharge lever 2 has a central bearing portion carried by bearing 5 and a foot 7 to discharge the bottom puck 20 and keep the next puck in the tube 9 until the discharge lever 2 returns to its initial position at which time the next puck is fed from tube 9 by gravity onto the base 1 and is ready to be discharged. The discharge lever 2 also includes a lever arm 3 with a covering pad 4 at its end to better receive an impact thereon. A lever weight 6 is attached to the discharge lever 2 creating an unbalanced moment to return the discharge lever 2 to its initial discharge position after actuation by impact. Spring means may replace lever weight 6 to return the discharge lever 2 to its initial discharge position. A tube 9 normally made of plastic is clamped firmly in an upright position by hose clamp type bands 11 and supported in tube clamp mounting 10 by a tube clamp mounting notch 13. The tube clamp mounting 10 is normally made of angle iron which can accommodate various sizes of tubes 9 however, the mounting 10 can be a form fit for the tube 9. A loading notch 12 at the upper end of tube 9 facilitates loading with several pucks 20.

Figure 2:
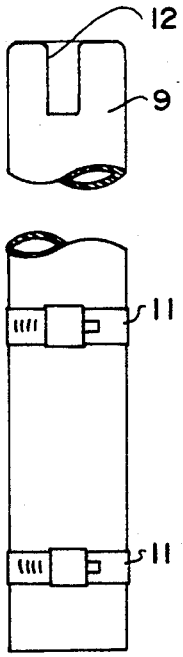
FIG. 2 is a rotated shortened view of the puck tube with supporting clamps

FIG. 2 depicts a rotated, shortened tube 9 to better show the loading notch 12 which permits entry of fingers holding several horizontal pucks 20 therebetween The tube clamps 11 are basically what are known as the hose clamp type and are adjusted by rotation of a threaded screw engaging the band.

Figure 3:
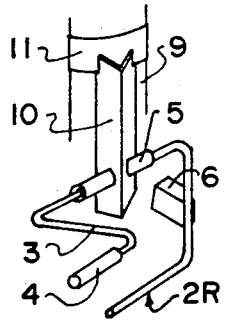
FIG. 3 is a reversed discharge lever and mounting which is more convenient for right hand players.

Now referring to FIG. 3 we have only a partial view of the device of FIG. 1. This partial view shows a discharge lever 2R which is basically discharge lever 2 with the crank arm 3 and weight 6 reversed to better accommodate a right handed hockey player. A right handed hockey player can use the device of FIG. 1 however it is not as convenient.

Figure 5:
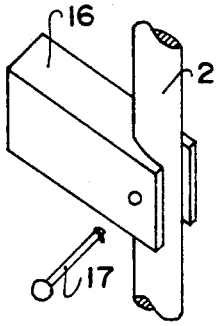
FIG. 5 is a reversible discharge lever weight for right or left hand adaptability.
Figure 4:
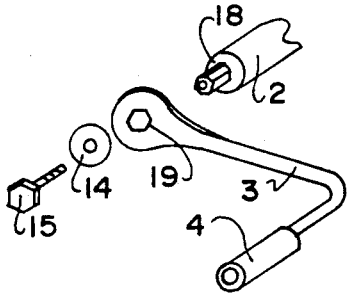
FIG. 4 is one form of a removable crank arm of the discharge lever for right or left hand adaptability

Now referring to FIGS. 4 and 5 we have shown the elements necessary to make the hockey practice device so that it can be easily altered for either left hand or right hand use. In FIG. 4 the discharge lever 2 has a protrusion 18 having several faces to engage several faces of opening 19 in a removable lever arm 3 secured by bolt 15 and washer 14. The lever arm connection can take various forms such as a split opening 19 being clamped by bolt means on protrusion 18, by key and keyway, by collar and set screw, by splines or any other mechanical equivalent that will allow relocation of lever arm 3. When the lever arm 3 has been relocated to change from left to right or vice versa it will also be necessary to relocate the weight 16 which is equivalent to weight 6 by removing pin 17 and rotating it 180° and inserting the pin 17. The pin 17 passes through a hole in weight 16 and discharge lever 2.

Figure 6:
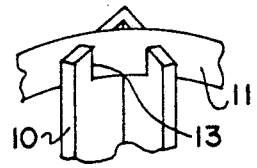
FIG. 6 is one example of a tube clamp mounting.

In FIG. 6 there is shown slots 13 in tube clamp mounting 10 for tube clamp 11. The tube clamp 11 could pass completely around tube clamp mounting 10 or be otherwise attached thereto.

While the impact force applied to lever arm pad 4 for puck discharge is normally by a hockey stick in the hands of a person using the practive device it is considered a mechanical equivalent to use an electrically operated device such as a motorized cam or hammer.

OPERATION

The hockey practice device described above is generally operated by persons desiring to develop their hockey skills such as puck handling, shooting and hand eye cooperation. To operate the device a person first must load the tube with as many pucks as desired, or as the device will hold. The person then with hockey stick in hand stands in front of the machine facing the discharge path of a puck being dispensed. The person then with his hockey stick strikes a downward blow on the lever arm pad, this rotates the lever arm about its bearing axis and the foot of the lever arm thrusts the bottom puck, resting on the base by gravity feed from the tube, toward the operator. The velocity attained by the puck is proportional to the degree of impact on the lever arm pad so the person has a choice depending on what skill he wishes to develop. When the puck is thrust at the person he may wish to dispose of it as quickly and accurately as possible, even possibly at a target. Disposing of as many pucks as possible within a certain time frame, with high accuracy may be most desirable. The practice device can of course be used as a normal convenient dispensing apparatus whereby the user can make optimum use of his time with a minimum of expense and/or concentrate on a certain type of shot. The location and use of this device is only limited by ones imagination.

Although the invention has been described with a certain degree of particularity it is understood that the present disclosure has been made only by way of example and that numerous changes in the details of construction and the combination and arrangement of parts may be resorted to without departing from the spirit and scope of the invention as hereinafter claimed.

What we claim is:

1. A hockey puck dispenser comprising in combination, a base, an upright support mounted on said base, a tube clamp mounting attached to said upright support a lever bearing attached to said tube clamp mounting, a discharge lever pivotably supported in said lever bearing, a leer weight attached to said discharge lever to provide a fast return of the discharge lever to its starting position, a tube mounted on said tube clamp mounting by tube clamps in such a manner that a stack of pucks may be stored in a vertical position to permit gravity feeding, whereby upon actuation of the discharge lever the bottom puck resting on the base will be discharged while the next puck is held in its present position until the discharge lever is returned to its starting position allowing the next puck to drop to the base ready for discharge.

2. Article dispensing means comprising, a base, article storing tube means, support means rigidly supporting said tube means on said base in a vertical position above said base, a discharge lever pivotally mounted on the support means, automatic discharge lever return means attached to said discharge lever, said discharge lever propelling said article by direct contact therewith upon application of a pivoting force thereto, said discharge lever simultaneously retaining a subsequent stored article in the tube until released for gravity feed upon pivoting return of the discharge lever, said support means comprising an upright support fixed to said base, a tube clamp mounting fixed to said upright support and tube clamps connected to said tube clamp mounting, said discharge lever including a foot at one end, an arm at the other end and an intermediate portion pivotally supported in the tube clamp mounting.

3. An article dispenser as claimed in claim 2 wherein the automatic discharge lever return means is a weight operated by the force of gravity.

4. An article dispenser as claimed in claim 3 wherein the tube means is circular and has at its uppermost end a cut away portion to facilitate loading it with the articles to be dispensed.

5. An article dispenser as claimed in claim 4 wherein the base is slightly concave and where the concavity faces downwardly.

6. A hockey practicing device comprising in combination a base, a puck storage tube, support means supporting said puck storage tube on said base in a vertical position above said base, a puck contacting bent discharge lever pivotally mounted on the support means, automatic discharge lever return means attached to said bent discharge lever, whereby a stack of pucks in the tube are gravity fed from the lower end of the tube onto the base in a controlled one by one manner and propelled horizontally both by a single actuation of the bent discharge lever.

7. A hockey practicing device as claimed in claim 6 wherein the bent discharge lever includes a foot at one end, an arm at the other end and an intermediate portion pivotally supported on the support means.

8. A hockey practicing device as claimed in claim 7 wherein the lever arm is releasably connected to the intermediate arm portion and the automatic discharge lever return means is releasably attached to said discharge lever whereby a remounting of the lever arm and automatic discharge lever return means can provide a device more suitable for a left hand or right hand operator as the desired case may be.

9. A hockey practicing device as claimed in claim 8 wherein the support means comprises an upright support fixed to said base, a tube clamp mounting fixed to said upright support and tube clamps connected to said tube clamp mounting.

10. A hockey practicing device as claimed in claim 9 wherein the automatic discharge lever return means is a weight functioning under the force of gravity.

11. A hockey practicing device as claimed in claim 9 wherein the tube clamp mounting is in the form of an angle iron and the tube is circular and made of plastic.

12. A hockey practicing device as claimed in claim 11 wherein the puck storage tube has at its uppermost end a cut away portion to facilitate loading it with pucks.

13. A hockey practicing device as claimed in claim 12 wherein the base is slightly concave and whose concavity faces downwardly.

14. A hockey practicing device as claimed in claim 8 wherein the automatic discharge lever return means is a weight functioning under the force of gravity.

15. A hockey practicing device as claimed in claim 8 wherein the lever arm is releasably splined to the intermediate portion of the discharge lever.

16. A hockey practicing device as claimed in claim 15 wherein the automatic discharge lever return means is releasably pinned to the bent discharge lever.

* * * * *